US006042493A

United States Patent [19]

Chauvin et al.

[11] Patent Number: 6,042,493

[45] Date of Patent: Mar. 28, 2000

[54] TUBULAR METAL BAT INTERNALLY REINFORCED WITH FIBER AND METALLIC COMPOSITE

[75] Inventors: Dewey Chauvin, Simi Valley; Larry Carlson, Santa Clarita; Gary Filice, Moorpark, all of Calif.

[73] Assignee: Jas. D. Easton, Inc., Van Nuys, Calif.

[21] Appl. No.: 09/079,325

[22] Filed: May 14, 1998

[51] Int. Cl.[7] ..... A63B 59/06

[52] U.S. Cl. ..... 473/566; 473/567

[58] Field of Search ..... 473/566, 567, 473/520, 519, 564, FOR 170

[56] References Cited

U.S. PATENT DOCUMENTS

| | | | |
|---|---|---|---|
| 1,611,858 | 12/1926 | Middlekauff . | |
| 2,379,006 | 6/1945 | Johnson | 273/72 |
| 3,116,926 | 1/1964 | Owen et al. | 273/72 |
| 3,727,295 | 4/1973 | Gildemeister | 29/455 |
| 3,801,098 | 4/1974 | Gildemeister | 273/72 |
| 3,811,596 | 5/1974 | Wilson | 220/24 |
| 3,830,496 | 8/1974 | Reizer | 273/72 |
| 3,861,682 | 1/1975 | Fujii | 273/72 |
| 3,876,204 | 4/1975 | Moore et al. | 273/72 |
| 3,963,239 | 6/1976 | Fujii | 273/72 |
| 3,972,528 | 8/1976 | McCracken et al. | 273/72 |
| 4,056,267 | 11/1977 | Krieger | 273/72 |
| 4,113,248 | 9/1978 | Yanagioka | 273/72 |
| 4,351,786 | 9/1982 | Mueller | 264/46.7 |
| 4,505,479 | 3/1985 | Souders | 473/567 |
| 4,569,521 | 2/1986 | Mueller | 273/72 |
| 4,600,193 | 7/1986 | Merritt | 273/72 |
| 4,951,948 | 8/1990 | Peng | 273/72 |
| 4,961,576 | 10/1990 | Meredith | 273/80 |
| 5,094,453 | 3/1992 | Douglas | 273/72 |
| 5,104,123 | 4/1992 | Okitsu et al. | 273/72 |
| 5,114,144 | 5/1992 | Baum | 273/72 |
| 5,131,651 | 7/1992 | You | 273/72 |
| 5,180,163 | 1/1993 | Lanctot et al. | 273/72 |
| 5,219,164 | 6/1993 | Peng | 273/67 |
| 5,364,095 | 11/1994 | Easton et al. | 273/72 |
| 5,393,055 | 2/1995 | MacKay | 273/72 |
| 5,415,398 | 5/1995 | Eggiman | 273/72 |
| 5,511,777 | 4/1996 | McNeely | 273/72 |
| 5,676,610 | 10/1997 | Bhatt | 473/566 |
| 5,759,113 | 6/1998 | Lai et al. | 473/520 |

FOREIGN PATENT DOCUMENTS

| | | |
|---|---|---|
| 4-303477 | 10/1992 | Japan . |
| 5-23407 | 2/1993 | Japan . |
| 2 247 932 | 3/1992 | United Kingdom . |

*Primary Examiner*—Mark S. Graham
*Attorney, Agent, or Firm*—Lyon & Lyon LLP

[57] ABSTRACT

The bat of the present invention has a barrel with a thinner outer shell in compressive and/or adhesive engagement with an insert laminate comprised of one or more pieces of a thin metallic (preferably titanium) sheet (or foil) and one or more sheets of a composite material. The titanium portion of the insert laminate may be on the inner-most portion of the insert, may be on the outer-most portion of the laminate, or may be in the interior of the laminate (that is, with one or more sheets of composite material on either side of it). Alternatively, the bat may simply be provided with only a titanium insert. In yet another set of embodiments, the titanium sheet may be replaced by another suitable metallic sheet. In all embodiments, the reinforcing sleeve allows the barrel portion to deflect farther when impacted by an object such as a ball without detrimental yielding (denting) and increases the rate of return of the barrel wall.

13 Claims, 2 Drawing Sheets

TUBULAR METAL BAT INTERNALLY REINFORCED WITH FIBER AND METALLIC COMPOSITE

The present invention is directed to providing an improved bat for use in softball and baseball.

BACKGROUND OF THE INVENTION AND PRIOR ART:

The invention relates generally to and is an improvement of reinforced tubular metal bats such as the Easton Aluminum, Inc. ("Easton") "C-Core" product disclosed in U.S. Pat. No. 5,364,095, which is hereby incorporated by reference as if it were set forth herein in its entirety. Baseball and softball bats today are typically made from aluminum or an aluminum alloy and are generally hollow inside. Such bats generally have a tubular outer shell comprising a barrel portion, a tapered portion, and a handle portion; a knob covering the end near the handle portion; and a cap covering the far end. Improvements in today's baseball and softball bats are directed to providing a wider "sweet spot," to reducing the sting and discomfort that often results from hitting the ball other than on the sweet spot, and to providing these improvements at reasonable costs and without sacrificing the bat's durability.

Bats have been improved by crafting the tubular outer shell entirely from titanium. This, however, raises the costs prohibitively because the titanium is very expensive and difficult to form. A titanium bat would have a retail sale price between 400 and 700 dollars.

Over the years, there have been many attempts to approach and surpass the level of performance rendered by the titanium bat without the commensurate costs. Most bat improvements today focus on the use of inserts that reinforce the barrel portion of the tubular outer shell. The object of using reinforcing inserts is to increase the compliance (flexibility) of the bat while simultaneously controlling the stress in the outer shell. That is, the reinforced bat is more compliant (or flexible) and can deflect more before experiencing permanent set or yield (that is, before it is dented). A more compliant bat is said to enhance player comfort and performance by reducing the amount of sting that can be experienced during ball impact. A more compliant bat is also said to have a wider "sweet spot." The use of reinforcing inserts also allows the manufacturer to make the barrel portion of the outer tubular shell substantially thinner, which may tend to make the bat lighter and/or reduce its material costs. Use of an appropriate reinforcing member in conjunction with a barrel with a thinner outer tubular shell provides a more compliant bat because such a design allows the outer shell to freely flex while offering enough modulus of elasticity (stiffness) to prevent the shell from deflecting to yield (denting).

One such approach is disclosed in the Easton U.S. Pat. No. 5,364,095, which discloses a bat with a reinforced fiber or composite material insert in compressive engagement with the barrel's outer shell. Others have attempted to increase bat compliance in several ways.

U.S. Pat. No. 5,414,398 to Eggiman, which is hereby incorporated by reference as if it were set forth herein in its entirety, discloses a bat with a tubular insert. The outside diameter of the insert is smaller than the inside diameter of the bat's outer shell so that there exists an annular gap between the two. The outside shell and tubular insert are therefore able to act independently and, by so doing, together act as a leaf spring, which is said to increase bat compliance while moderately limiting the force required to yield (dent) the barrel portion.

U.S. Pat. No. 5,676,610 to Bhatt et al., which is hereby incorporated by reference as if it were set forth herein in its entirety, teaches inserting a sheet of metal, wound into a spiral spring, into the bat's barrel. The sheet is of sufficient length to wrap 1.1 to 3 times the inside circumference of the tubular bat barrel.

U.S. Pat. No. 5,511,777 to McNeely, which is hereby incorporated by reference as if it were set forth herein in its entirety, teaches a bat having a rebounding core therein. The McNeely bat comprises a resilient attenuator sleeve compressed between the bat's outer shell and an inner damper, fashioned from brass or a similar material. The resilient attenuator sleeve may be fashioned from a polystyrene closed cell foam.

Despite the advances claimed in these patents, today's most expensive and supposedly "high performance" bats are still susceptible to denting. Alternatively, the more durable bats are not sufficiently compliant.

SUMMARY OF THE INVENTION

Therefore, in view of the foregoing, it is an object of the present invention to provide an improved bat for use in softball and baseball.

To achieve this, the bat of the present invention has a barrel with a thinner outer shell and an insert laminate comprised of one or more pieces of a thin titanium sheet (or foil) and one or more sheets of a composite material. The titanium portion of the insert laminate may be on the inner-most portion of the insert, may be on the outer-most portion of the laminate, or may be sandwiched in the interior of the laminate (that is, with one or more sheets of composite material on either side of it). Alternatively, the bat may simply be provided with only a titanium insert. In yet another set of embodiments, the titanium sheet may be replaced by another suitable metallic sheet.

BRIEF DESCRIPTION OF THE DRAWINGS

FIG. 4 is a sectional view showing an embodiment of the present invention comprising, from the outside, inward, the outer shell (20), a titanium sheet (41) and two sheets of a composite material (42*a*, 42*b*), with layers of adhesive (43) in between.

FIG. 5 is a sectional view showing an alternative embodiment of the present invention comprising, from the outside, inward, the outer shell (20), a first composite sheet (42*a*), a titanium sheet (41) and a second composite sheet (42*b*), with layers of adhesive (43) in between.

FIG. 6 is a sectional view showing an alternative embodiment of the present invention comprising, from the outside, inward, the outer shell (20), two sheets of a composite material (42*a*, 42*b*) and a titanium sheet (41), with layers of adhesive (43) in between.

Figure 1:
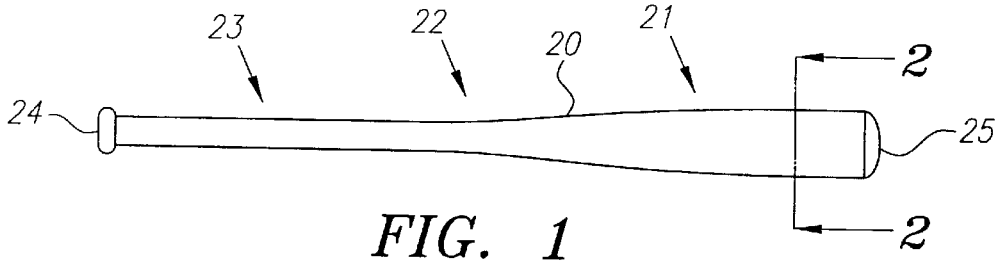
FIG. 1 is a side view of a metallic bat.
Figure 2:
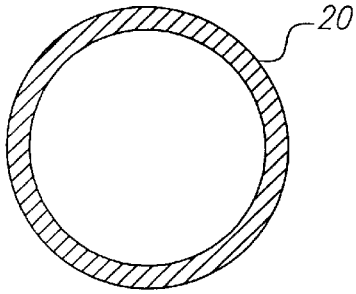
FIG. 2 is a cross-sectional view of a standard metallic bat taken along line 2—2 of FIG. 1.
Figure 3:
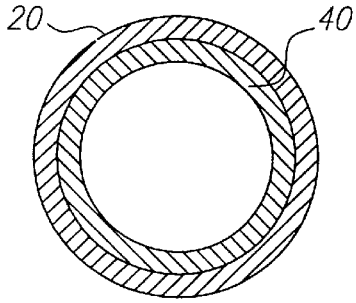
FIG. 3 is a cross-sectional view of a bat with an insert laminate (40) taken along line 2—2 of FIG. 1.

The figures are not drawn to scale.

DETAILED DESCRIPTION OF THE INVENTION

The present invention is directed to providing an improved metallic bat, and in particular, to providing an improved aluminum bat. Such bats, whether for baseball or softball, generally have a tubular outer shell (20) comprising a barrel portion (21), a tapered portion (22), and a handle (23) portion; a knob (24) covering the end near the handle (23) portion; and a cap (25) covering the far end.

Most baseball bat barrels (21) have a maximum outside diameter of 2.75 inches, but some have a maximum outside diameter of 2.625 inches. Unless the bat is continuously tapered from barrel (21) to handle (23) (a constant taper), the barrel (21) will typically have a section with a constant diameter. The constant-diameter section may range in length from near 0 inches (a constant taper) to 10–12 inches. The barrel (21) of the outer shell (20) of an aluminum baseball bat without a reinforcing insert is typically from 0.105 to 0.140 inches thick.

Softball bat barrels (21) typically have a maximum outside diameter of 2.25 inches and have a constant-diameter section that ranges in length from 8 to 18 inches. The outer shells (20) of aluminum softball bats without reinforcing inserts typically have a barrel (21) wall thickness between 0.070 and 0.090 inches.

In the bat of the present invention, the barrel (21) is provided with an insert laminate (40) comprised of one or more pieces of a thin metallic sheet (or foil) (41) and one or more sheets of a composite material (42). The preferred embodiment of the present invention uses titanium sheets (41) because they provide an optimal blend of high strength and moderate modulus of elasticity (stiffness). The high strength features of the titanium sheet (41) provides dent protection while the moderate modulus of elasticity (approximately 15,000,000 psi) does not substantially impede the bat's compliance. Titanium sheets (41) as thin as 0.001 inch thick or as thick as 0.030 inches may be used, providing a large degree of control over the barrel's (21) stiffness and strength. The titanium can be prepared for bonding directly to the interior surface of the barrel (21) or can be used in conjunction with traditional composite fiber reinforcing materials (e.g., graphite or carbon, fiberglass, Kevlar™, Spectra™, Vectran™). The insert laminate (40) may be held together strictly by compressive forces, strictly by adhesive bonding or, more preferably, by both compressive forces and adhesive bonding. Similarly, insert laminate (40) may be held against the interior of the outer shell (20) strictly by compressive forces, strictly by adhesive bonding or, more preferably, by both compressive forces and adhesive bonding.

Other metals could also be used, but would likely entail design compromises. For instance, steels, while being similar to titanium in strength, have a significantly higher modulus of elasticity (typically 30,000,000 psi) which can impede the bat's compliance.

Thus, one advantage of the present invention is to bring the desirable characteristics of titanium to bat production without the costs of manufacturing a bat entirely or mainly from titanium. Indeed, with the present invention, costs are saved two ways: first, material costs are substantially reduced because only a small amount of titanium need be used; second, substantial production costs are saved because it is easier to use a titanium sheet insert (41) than to fashion a bat entirely or mostly from titanium. It is anticipated that a bat with the titanium insert laminate (40) of the present invention would have a retail sale price 50 percent less than would a bat fashioned all or mostly from titanium. It should also be appreciated that bat makers can use the present invention to fashion bats with different qualities (e.g. weight, strength, flex, and size) by varying the composition of the insert laminate (40). Thus, design flexibility is yet another advantage of the present invention.

Design flexibility is also enhanced because the bat's modulus of elasticity (stiffness) and strength can be varied by choosing composite materials (42) with different fiber material properties and fiber angles. For example, fiberglass epoxy systems have high strain capabilities (over 3% elongation at failure), with low modulus of elasticity (6,000,000 psi). Graphite epoxy systems have higher strength and modulus of elasticity than fiberglass but typically have much lower strain (1–1.5% elongation at failure).

Other fiber reinforcing materials (e.g. Kevlar™, Spectra™, Vectran™) have a low modulus of elasticity (<10,000,000 psi) and extremely high elongation properties (greater than fiberglass and often times steel). Use of these fibers is limited due to their low compressive strengths and bonding strengths. Systems can be and have been designed using these products but the designs must compensate for their limited ability to carry compressive loads. Nevertheless, it will be appreciated that bats with a wide variety of strengths and compliances can be created by employing a variety of composite materials.

Judicious construction of the insert laminate (40) can also offer a means of damping unwanted bat vibration. Increasing the amount of damping can also reduce the pinging sound sometimes found objectionable in aluminum bats. For example, the fiberglass in the titanium-composite embodiment of the present invention provides adequate damping to alter the normal metallic "ping" sound and approximate the sound generated by a wooden bat.

First Set of Embodiments

Figure 4:
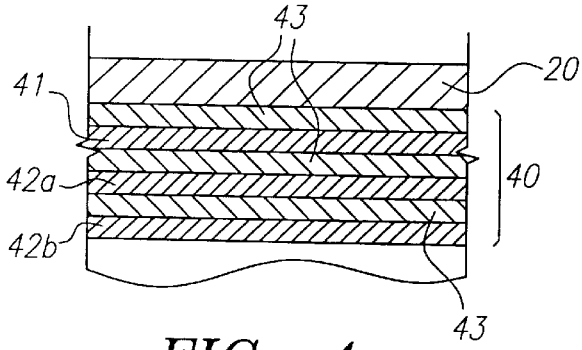
Figure 5:
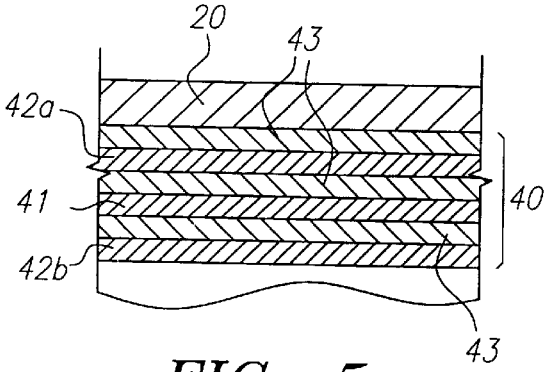
Figure 6:
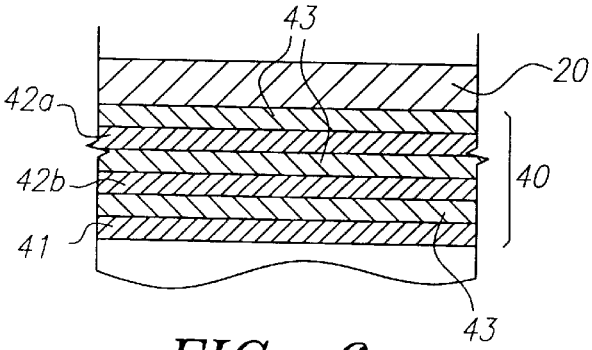
Figure 7:
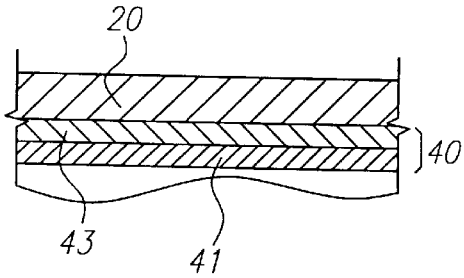
FIG. 7 is a sectional view showing an embodiment of the present invention comprising only a titanium sheet bonded to the interior of the outer shell (20) with adhesive (43).

In the most preferable set of embodiments, one or more titanium sheets (41) are used in conjunction with one or more sheets of a composite material (42). The titanium sheet (41) of the insert laminate (40) may be on the inner-most portion of the insert laminate (40) (e.g. FIG. 6), may be on the outer-most portion of the insert laminate (40) (e.g. FIG. 4), or may be in the interior of the insert laminate (40) (that is, with one or more sheets of composite material (42) on either side of it)(e.g. FIG. 5). Such structures increase the overall stress-carrying capability of the bat while providing the desired amount of compliance. The materials are preferably held together by both compressive forces and by adhesive bonding.

The current preferred embodiment is a bat for softball (both slow and fast pitch). The tubular aluminum bat barrel (21) has a 2.25 inch diameter with a wall that is 0.045–0.052 inches thick, which is substantially thinner than the wall of a traditional aluminum softball bat. A titanium sheet (41) measuring one internal circumference in width (i.e., 6.78 inches for a 0.045 inch wall; 6.74 inches for a 0.052 inch wall) by 0.009 inch thick is bonded to the aluminum barrel (21) using a film adhesive (43) and bonding techniques well known in the art. (See, e.g. U.S. Pat. No. 5,578,384 to Kingston, which is hereby incorporated by reference as if fully set forth herein). While the thickness of the titanium sheet (41) is optimally 0.009 inches, it may range from 0.001–0.030 inches. The length of the titanium sheet (41) is determined by the length of the bat's constant-diameter section. See infra. Two sheets of a composite material (42*a*, 42*b*), preferably an S-glass fiberglass and low modulus of elasticity graphite in a toughened resin system (e.g. Newport 304 by Newport Adhesives & Composites, Inc., Irvine, Calif.), are then bonded to the titanium sheet (41) by bonding techniques such as disclosed in Easton U.S. Pat. No. 5,364,095. The composite material sheets (42*a*, 42*b*) are cut to the same length as the titanium sheet (41) with a width 0.10 to 0.75 inches greater than the local internal circumference. The thickness of each composite sheet (42*a*, 42*b*) is optimally 0.006 inches, but can range from 0.003–0.030 inches.

Use of the cure process disclosed in Easton U.S. Pat. No. 5,364,095, or a similar process, generates compressive forces between the layers of the insert laminate (40) and/or between the insert laminate (40) and the outer shell (20). These compressive forces are due to the differentials in the thermal coefficients of expansion of the metallic outer shell (20) and the materials of the insert laminate (40), and are sufficient to improve the engagement provided by adhesive bonding (43) initially applied.

The length of the titanium and composite sheets are commensurate with the length of the constant diameter section of the bat barrel (21) minus a small section at the end of the bat for handling and cap-retention machining. In practice, most slow pitch bats have an 11 inch constant diameter barrel (21) section which receive a 9-inch insert laminate (40). The fast pitch bats with shorter constant diameter barrel (21) sections (11–13 inches) receive a 9-inch insert laminate (40) while all the bats with longer constant diameter barrel (21) sections (14–18 inches) receive a 12-inch long insert laminate (40).

While the composite sheets (42*a*, 42*b*) can be oriented at a wide variety of angles, the preferred embodiment employs a "+45/−45 configuration." That is, one composite sheet (42*a*) is positioned at a +45 degree angle relative to the cylindrical axis of the bat, and the other composite sheet (42*b*) is positioned at a −45 degree angle relative to the cylindrical axis of the bat. Alternatively, the composite sheets (42*a*, 42*b*) should be positioned so that they are at 90 degree angles with respect to each other. It will be appreciated by those skilled in the art that use of a different composite material may necessitate changes in the optimal configuration.

Second Set of Embodiments

Figure 9:
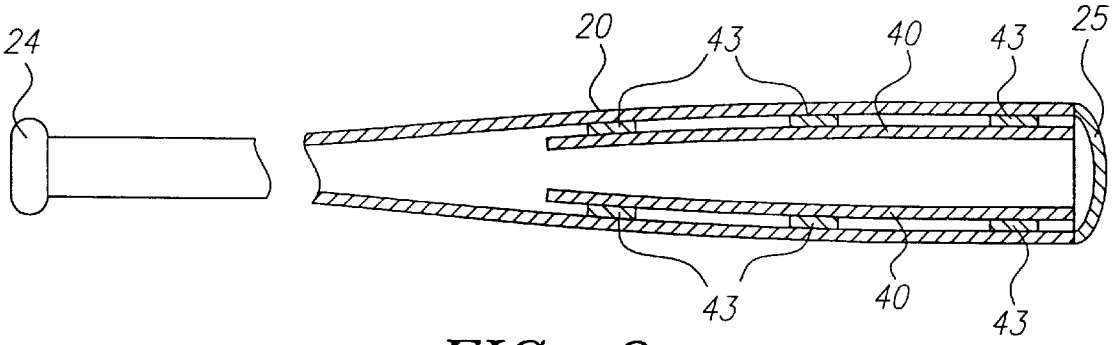
FIG. 9 is a sectional view showing an insert laminate (40) bonded to the interior of the outer shell (20) by a series of cylindrical-shaped portions of adhesive (43).

In yet another set of embodiments, the insert laminate (40) is only partially bonded to the interior of the barrel (21) (e.g. FIG. 9). Alternatively, the layers of the insert laminate (40) are only partially bonded to each other. These embodiments enhance the bat's compliance because they tend to localize the force of the impact. Improvements in adhesives and bonding techniques, as well as in the strength of composite materials (42) allow the partially bonded bat of the present invention to perform without cracking the bonding (43), cracking the composite material (42), or delaminating.

Figure 10:
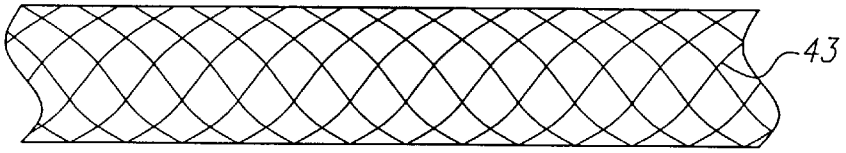
FIG. 10 shows an example of a net-like configuration of adhesive to be used to accomplish partial bonding.
Figure 11:
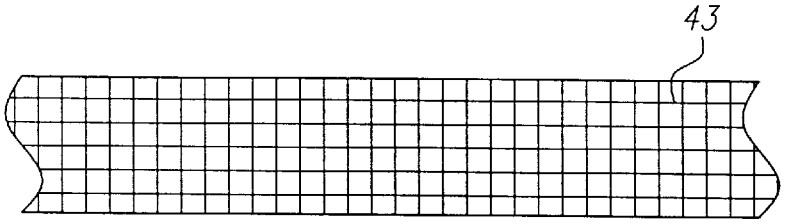
FIG. 11 shows an example of a cross-hatch configuration of adhesive to be used to accomplish partial bonding.

Various patterns of partial bonding may be used. For instance, in one embodiment, the titanium sheet (41) is bonded to the interior of the barrel (21) by a series of cylindrical portions of adhesive (43) (e.g. FIG. 9). Any regularly repeating geometric pattern of adhesive can be advantageously employed to improve the bat's compliance. For instance, a cross-hatch or net-like configuration of adhesive, such as is shown in FIGS. 10 and 11, respectively, may be used to bond the insert laminate to the interior of the barrel, or to bond the layers of the insert laminate to each other.

Third Set of Embodiments

Figure 8:
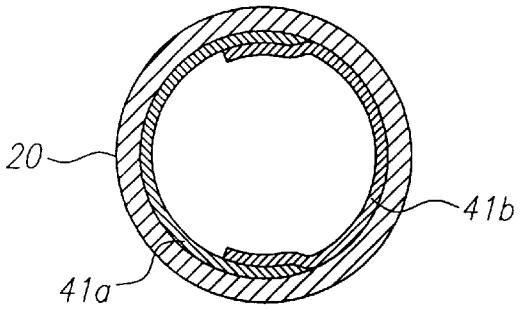
FIG. 8 is an embodiment of the "double-C" configuration of the present invention, comprising the outer shell (20) and two sheets of titanium (41*a*, 41*b*).

Yet another set of embodiments employs two or more metallic (preferably titanium) sheets (41) in a "multiple-C" configuration (e.g. FIG. 8). In a two-sheet, or "double-C" configuration, each titanium sheet (41*a*, 41*b*) has a width that is greater than 50% but less than 100% of the local internal circumference. The first titanium sheet (41*a*) is positioned radially opposite to the second titanium sheet (41*b*) inside the barrel (21) so that at least a portion of the titanium sheets (41*a*, 41*b*) overlap each other. Such a configuration is advantageous because it allows for the use of sheets of titanium that are thinner and narrower (in width). Such sheets are substantially easier to work with than are the thicker and wider sheets. Further, use of the double-C configuration can also substantially increases the bat's compliance.

The sheets of titanium in a double-C type configuration may be partially or entirely bonded to the interior of the outer shell (20), and may be used in conjunction with a sheet or sheets of a composite material (42). Compressive forces may be used to improved the engagement of the insert laminate (40). It will be appreciated by those skilled in the art that a "triple-C" configuration may be created by using three metallic sheets (41), each having a width greater than 33% but less than 100% of the local internal circumference. The sheets (41) in the triple-C configuration are then positioned so that each overlaps with at least a portion of each of the other two sheets (41). Indeed, any multiple-C configuration created in this manner is within the scope of this invention.

Although the present invention has been described in considerable detail with reference to certain preferred embodiments thereof, other embodiments are possible. Therefore, the spirit and scope of the appended claims should not be limited to the description of the preferred embodiments contained herein.

What is claimed:

1. A bat, comprising:

a tubular outer shell having a handle, a barrel, and a tapered portion therebetween;

and an insert laminate at least partially bonded to the interior surface of the barrel, wherein said insert laminate comprises a metallic sheet and two sheets of a composite material;

said insert laminate being formed by bonding at least a portion of the metallic sheet to the interior surface of said outer shell and subsequently bonding the composite materials to the interior surface of the metallic sheet in such a manner as to generate compressive forces between said insert laminate and said outer shell.

2. The bat of claim 1, wherein the barrel is between 0.020 to 0.058 inches thick.

3. The bat of claim 1, wherein the barrel is between 0.045 and 0.052 inches thick.

4. The bat of claim 1, wherein the barrel has a constant-diameter section; and wherein the length of said insert laminate is slightly less than the length of the constant-diameter section.

5. The bat of claim 1, wherein each sheet of composite material is oriented at approximately 90 degree angles with respect to each other.

6. The bat of claim 1, wherein each sheet of composite material is oriented at approximately 45 degree angles with respect to the longitudinal axis of the bat.

7. The bat of claim 1, wherein said composite material is an S-glass fiberglass and low modulus-of-elasticity graphite in a toughened resin system.

8. The bat of claim 1, wherein said composite material is Newport 304.

9. The bat of claim 1, wherein said composite material comprises reinforcing fibers in a bi-directional pattern in a resin matrix.

10. The bat of claim 1, wherein the composite material comprises woven reinforcing fibers in a bi-directional pattern in a resin matrix.

11. A bat as in any one of claims 1–10 inclusive, in which the metallic sheet is titanium.

12. A bat, comprising:

a tubular outer shell having a handle, a barrel, and a tapered portion therebetween;

and an insert laminate at least partially bonded to the interior surface of the barrel, wherein said insert laminate comprises three metallic sheets having a width greater than 33% but less than 100% of the barrel's local internal diameter, said sheets being positioned radially inside the barrel so that at least a portion of each of said sheets overlaps with at least a portion of each of said other two sheets.

13. A bat as in claim 12 in which the metallic sheets are titanium.

* * * * *